US010238923B1

(12) United States Patent
Li

(10) Patent No.: US 10,238,923 B1
(45) Date of Patent: Mar. 26, 2019

(54) GOLF PUTTER

(71) Applicant: Lien-An Li, Kaohsiung (TW)

(72) Inventor: Lien-An Li, Kaohsiung (TW)

( * ) Notice: Subject to any disclaimer, the term of this patent is extended or adjusted under 35 U.S.C. 154(b) by 0 days.

(21) Appl. No.: 15/902,557

(22) Filed: Feb. 22, 2018

(30) Foreign Application Priority Data

Sep. 26, 2017 (TW) ..... 106214280 U

(51) Int. Cl.

| | |
|---|---|
| ***A63B 53/06*** | (2015.01) |
| ***A63B 53/00*** | (2015.01) |
| *A63B 53/04* | (2015.01) |
| *A63B 53/02* | (2015.01) |

(52) U.S. Cl.
CPC ..... *A63B 53/007* (2013.01); *A63B 53/02* (2013.01); *A63B 53/0487* (2013.01); *A63B 53/06* (2013.01); *A63B 53/065* (2013.01); *A63B 2053/022* (2013.01); *A63B 2053/0437* (2013.01)

(58) Field of Classification Search
CPC ..... A63B 53/02; A63B 53/06; A63B 53/0487; A63B 53/065; A63B 2053/022; A63B 2053/0437; A63B 53/007
USPC ..... 473/315, 305, 307, 314, 340
See application file for complete search history.

(56) References Cited

U.S. PATENT DOCUMENTS

| | | | | |
|---|---|---|---|---|
| 4,506,888 A * | 3/1985 | Nardozzi, Jr. | ..... | A63B 53/007 |
| 5,533,730 A * | 7/1996 | Ruvang | ..... | A63B 53/02 473/251 |
| 6,001,024 A * | 12/1999 | Van Alen, II | ..... | A63B 53/02 473/244 |
| 6,988,956 B2 * | 1/2006 | Cover | ..... | A63B 53/065 473/244 |

* cited by examiner

*Primary Examiner* — Benjamin Layno
(74) *Attorney, Agent, or Firm* — LeClairRyan

(57) ABSTRACT

A golf putter includes a head and a shaft. The head has a head body having a top surface that is formed with a mounting groove. The shaft has a main body portion and a connecting portion connected to the main body portion. The connecting portion is inserted into the mounting groove, is movable along the mounting in a longitudinal direction, and has a non-circular cross-section, such that the connecting portion is non-rotatable relative to the mounting groove of the head.

2 Claims, 5 Drawing Sheets

GOLF PUTTER

CROSS-REFERENCE TO RELATED APPLICATION

This application claims priority of Taiwanese Patent Application No. 106214280, filed on Sep. 26, 2017.

FIELD

The disclosure relates to a golf club, and more particularly to a golf putter.

BACKGROUND

Referring to FIG. 1, generally, a conventional golf putter 1 includes a head 11 and a shaft 12 fixedly connected to the head 11. The position on the head 11 at which the shaft 12 is connected to is a determining factor of a golfer's shot. However, the shaft 12 of the conventional putter 1 is nonadjustable relative to the head 11 due to such fixed connection therebetween, which causes inconvenience in use. To solve this problem, referring to FIG. 2, another conventional golf putter 2 is designed to include a head 21, a cylindrical shaft 23, and a fixing hole 22 that is formed in a top surface of the head 21. The shaft 23 is inserted into the fixing hole 22 and is movable along the fixing hole 22, such that the golfer can adjust the position of the shaft 23 relative to the head 21.

However, since the shaft 23 has a circular cross-section, rotation of the shaft 23 relative to the fixing hole 22 may occur during play, thereby resulting in inaccuracy of the golf shot.

SUMMARY

Therefore, an object of the disclosure is to provide a golf putter that can alleviate the drawback associated with the abovementioned prior art.

Accordingly, the golf putter includes a head and a shaft. The head has a head body having a top surface that is formed with a mounting groove. The shaft has a main body portion and a connecting portion connected to the main body portion. The connecting portion is inserted into the mounting groove, is movable along the mounting groove in a longitudinal direction, and has a non-circular cross-section, such that the connecting portion is non-rotatable relative to the mounting groove of the head.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
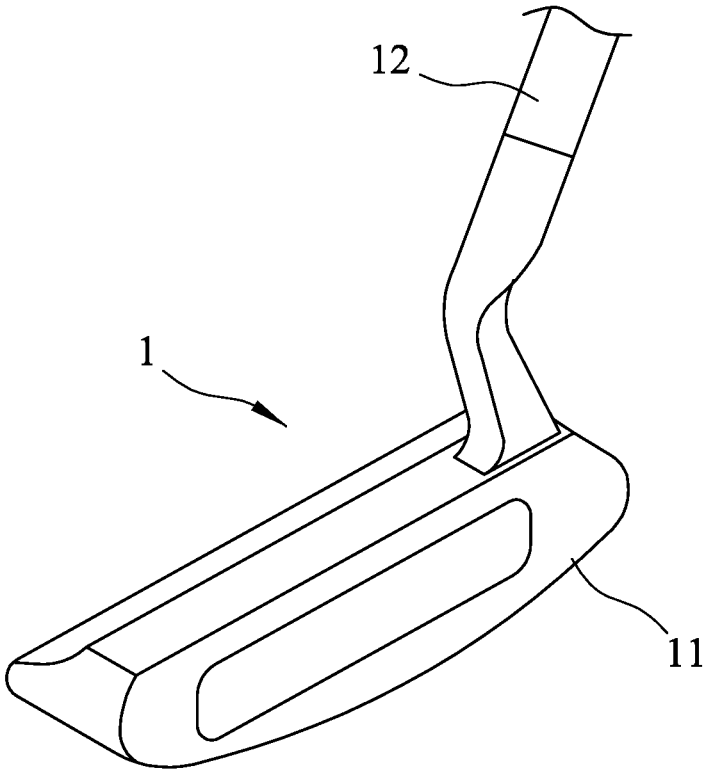
FIG.1 PRIOR ART
FIG. 1 is a fragmentary perspective view of a conventional golf putter.
Figure 2:
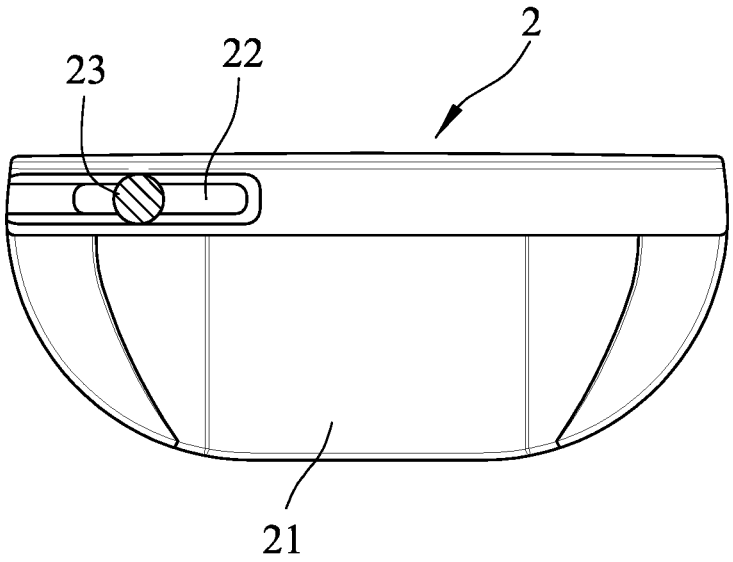
FIG.2 PRIOR ART
FIG. 2 is a sectional view of another conventional golf putter.
Figure 3:
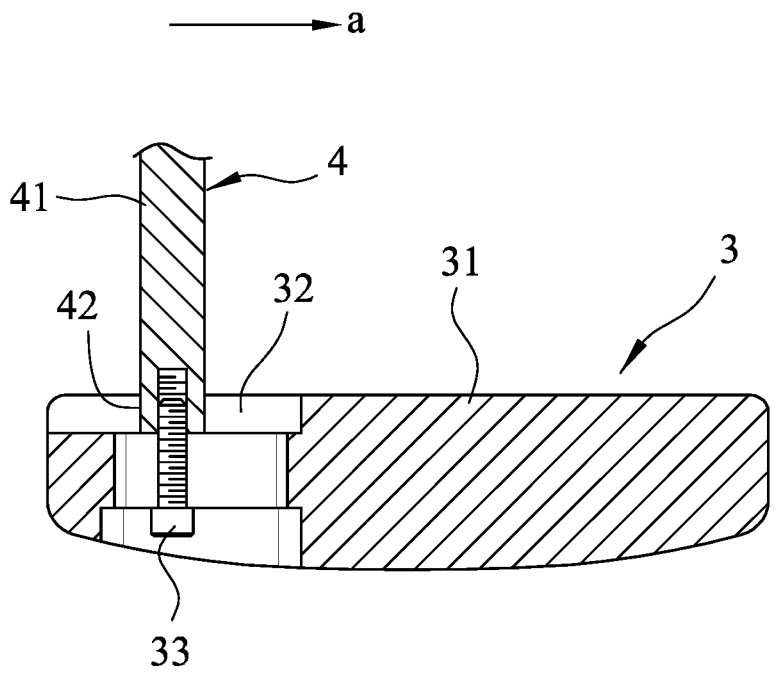
FIG. 3 is a fragmentary sectional view of an embodiment of a golf putter according to the present disclosure.

Referring to FIG. 3, an embodiment of a golf putter according to the present disclosure includes a head 3 and a shaft 4.

The head 3 has a head body 31 having a top surface that is formed with a mounting groove 32. The shaft 4 has a main body portion 41 and a connecting portion 42. The connecting portion 42 is connected to the main body portion 41, is inserted into the mounting groove 32, is movable along the mounting groove 32 in a longitudinal direction (a), and has a non-circular cross-section, such that the connecting portion 42 is non-rotatable relative to the mounting groove 32 of the head 3. The head 3 further has a securing member 33 extending upwardly into the head body 31 for threadedly and fixedly connected to a bottom end of the connecting portion 42.

Figure 4:
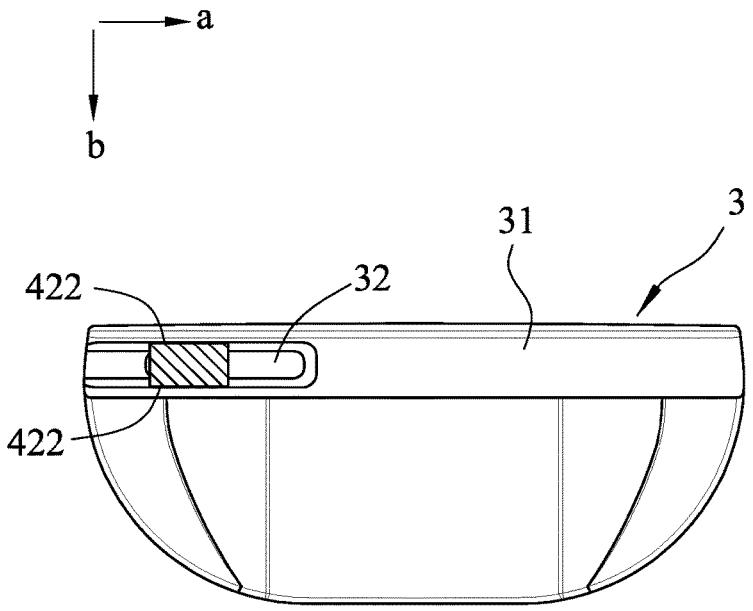
FIG. 4 is a sectional view of the embodiment.
Figure 5:
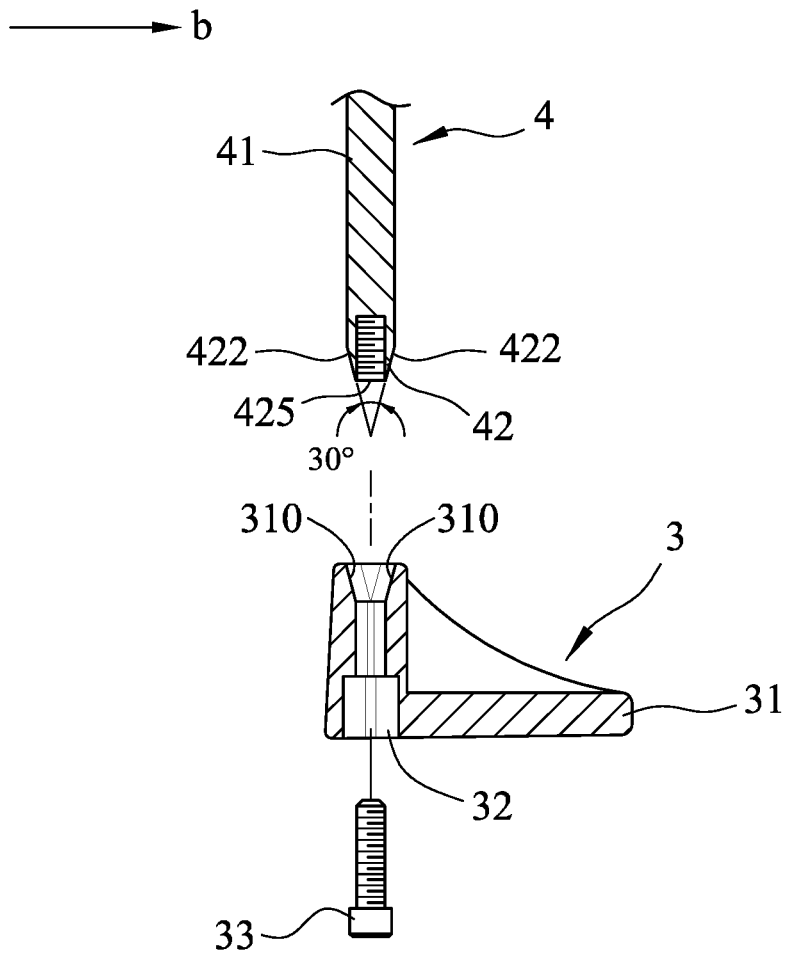
FIG. 5 is a fragmentary exploded sectional view of the embodiment.

Referring to FIGS. 4 and 5, in this embodiment, the connecting portion 42 has two flat engaging surfaces 422 spaced apart from each other in a width direction (b) which is perpendicular to the longitudinal direction (a), and abutting respectively against opposite inner groove surfaces 310 of the head body 31 which face the mounting groove 32. The connecting portion 42 further has a bottom end surface 425 interconnecting the engaging surfaces 422. The engaging surfaces 422 are inclined toward each other in a direction away from the main body portion 41 of the shaft 4, and extensions of the engaging surfaces 422 cooperatively define an angle that is 30 degrees. Such configuration of the inclined engaging surfaces 422 facilitates the insertion of the connecting portion 42 of the shaft 4. In addition, the connecting portion 42 has sufficient contact with the head body 31 due to abutment of the engaging surfaces 422 against the inner groove surfaces 310 of the head body 31, so as to ensure a firm engagement between the shaft 4 and the head 3. It should be noted that in other embodiments, the connecting portion 42 may have only one flat engaging surface 422 abutting against an inner groove surface 310 of the head body 31 which faces the mounting groove 32.

In summary, by virtue of the connecting portion 42 having a non-circular cross section and being formed with the engaging surfaces 422, the rotation of the connecting portion 42 relative to the mounting groove 32 can be prevented.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that his disclosure is not limited to the disclosed embodiment but is intended to cover various arrangements included within the spirit and scope of the broadest interpretation so as to encompass all such modifications and equivalent arrangements.

What is claimed is:

1. A golf putter comprising:

a head having a head body that has a top surface formed with a mounting groove; and a shaft having a main body portion, and a connecting portion that is connected to said main body portion, that is inserted into said mounting groove, that is movable along said mounting groove in a longitudinal direction, and that has a non-circular cross-section, such that said connecting portion is non-rotatable relative to said mounting groove of said head, wherein said connecting portion has two flat engaging surfaces spaced apart from each other in a width direction which is perpendicular to the longitudinal direction, and abutting respectively against opposite inner groove surfaces of said head body which face said mounting groove; and wherein said engaging surfaces are inclined toward each other in a direction away from said main body portion of said shaft.

2. The golf putter as claimed in claim 1, wherein extensions of said engaging surfaces cooperatively define an angle that is 30 degrees.

* * * * *